US007198095B2

(12) United States Patent
Nguyen

(10) Patent No.: US 7,198,095 B2
(45) Date of Patent: Apr. 3, 2007

(54) HEAT EXCHANGER, ESPECIALLY A HEAT EXCHANGING MODULE, FOR A MOTOR VEHICLE

(75) Inventor: Chi-Duc Nguyen, Lorch-Waldhausen (DE)

(73) Assignee: BEHR GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/510,102

(22) PCT Filed: Apr. 11, 2003

(86) PCT No.: PCT/EP03/03771

§ 371 (c)(1),
(2), (4) Date: Oct. 5, 2004

(87) PCT Pub. No.: WO03/091649

PCT Pub. Date: Jun. 11, 2003

(65) Prior Publication Data

US 2005/0121178 A1 Jun. 9, 2005

(30) Foreign Application Priority Data

Apr. 23, 2002 (DE) ..... 102 18 048

(51) Int. Cl.
*F28F 9/007* (2006.01)

(52) U.S. Cl. ..... 165/81; 165/149

(58) Field of Classification Search ..... None
See application file for complete search history.

(56) References Cited

U.S. PATENT DOCUMENTS

| | | | | |
|---|---|---|---|---|
| 1,357,597 | A * | 11/1920 | Springer | 165/149 |
| 4,719,967 | A | 1/1988 | Scarselletta | |
| 5,186,239 | A * | 2/1993 | Young et al. | 165/81 |
| 5,257,454 | A * | 11/1993 | Young et al. | 29/890.043 |
| 5,931,223 | A * | 8/1999 | Yu et al. | 165/81 |
| 5,954,123 | A * | 9/1999 | Richardson | 165/81 |
| 6,129,142 | A * | 10/2000 | Beldam | 165/81 |
| 6,328,098 | B1 * | 12/2001 | Kodumudi et al. | 165/149 |
| 6,412,547 | B1 * | 7/2002 | Siler | 165/81 |
| 6,523,603 | B2 * | 2/2003 | Uchikawa et al. | 165/81 |
| 6,736,193 | B2 * | 5/2004 | Kodumudi et al. | 165/81 |

FOREIGN PATENT DOCUMENTS

| | | |
|---|---|---|
| EP | 1 001 241 A2 | 5/2000 |
| EP | 1 195 573 A1 | 4/2002 |
| JP | 11-325783 A | 11/1999 |

* cited by examiner

*Primary Examiner*—Allen J. Flanigan
(74) *Attorney, Agent, or Firm*—Foley & Lardner LLP

(57) ABSTRACT

The invention relates to a heat exchanger for a motor vehicle. Said heat exchanger especially comprises a heat exchanging module provided with a plurality of pipes and corrugated ribs which are interconnected in the form of a network structure, and two lateral parts (1) which border the heat exchanging module on opposite sides. At least one break-off point (8) is provided on a lateral part (1).

16 Claims, 2 Drawing Sheets

HEAT EXCHANGER, ESPECIALLY A HEAT EXCHANGING MODULE, FOR A MOTOR VEHICLE

The invention relates to a heat exchanger, in particular a heat exchanger module, for a motor vehicle.

In heat exchangers in the form of a heat exchanger module, that is to say in which the condenser and the coolant cooler are connected to one another as a unit via corrugated ribs and side parts, temperature changes and associated periodically different temperature levels in the heat exchanger and coolant cooler result, due to the different thermal expansion states, in stresses which may lead to leaks. Furthermore, the temperature changes and the associated stress changes load the formed tube ends of the flat tubes of the heat exchanger module, and this may lead, here to leaks.

For this reason, in conventional heat exchangers, expansion beads in the side part are provided, as illustrated, for example, in FIG. 3 in the region identified by a circle. The production of expansion beads of this type requires special forming tools and an additional consumption of material as a result of the shaped-out beads.

The object of the invention is to improve a heat exchanger of this type.

According to the invention, a heat exchanger for a motor vehicle with a heat exchanger module is provided, which has a side part with at least one predetermined breaking point. In this case, the predetermined breaking point lies preferably in the region of the tube forming or at an interface between the condenser part (in particular, flat-tube condenser) and the coolant cooling part (in particular, coolant cooler) of the heat exchanger module.

Preferably, the predetermined breaking point is formed by webs, in particular by three webs, which are separated from one another by means of cutouts arranged in a V-shaped manner.

Preferably, the webs have a width of 0.5 to 2 mm, in particular 1 to 1.5 mm, with the result that the predetermined breaking point breaks even under relatively low loads and the flat tubes of the heat exchanger are protected.

Preferably, the heat exchanger is designed in such a way that a marginal region of the side part is bent through approximately 90° along the longitudinal edge of the side part and is interrupted in the region of the predetermined breaking point by cutouts.

Preferably, the webs are delimited laterally by cutouts, at least one of which is of angular design in the direction of the webs, in particular with an angle of 90° or less, that is to say is sharp-edged.

The invention is explained in detail below by means of an exemplary embodiment, with reference to the drawing in which.

Figure 1:
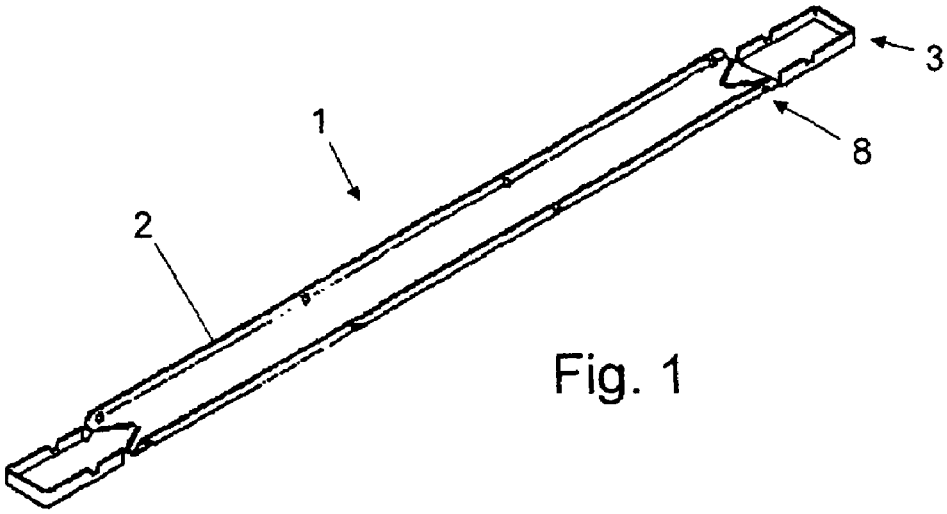
FIG. 1 shows a perspective illustration of a side part of a heat exchanger module.
Figure 2:
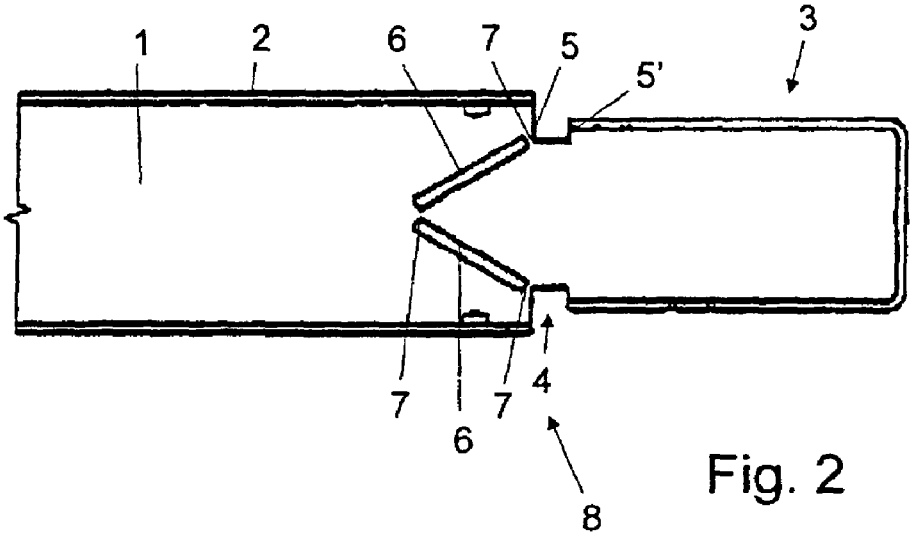
FIG. 2 shows a top view of an end region of the side part of FIG. 1.
Figure 3:
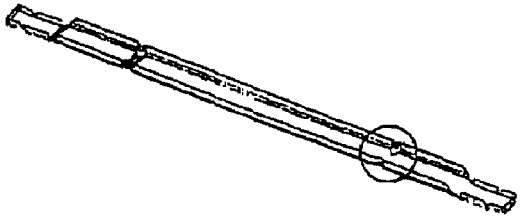
FIG. 3 shows a perspective illustration of a side part of a heat exchange module according to the prior art.

A heat exchanger according to the invention, in the form of a soldered all-aluminum heat exchanger module, has a flat-tube condenser, a coolant cooler, which comprise a plurality of flat tubes and corrugated ribs connected to one another in the manner of a net structure, and two side parts 1 which are located opposite one another and one of which is illustrated in FIGS. 1 and 2.

Reference is made below to FIG. 2, the configuration of the side parts 1 being essentially symmetrical at both ends. The side part 1, a bent sheet aluminum part, has a marginal region 2 running essentially around the entire side part 1 and bent to approximately 90° upward, that is to say away from the flat-tube condenser and coolant cooler. The marginal region 2 is interrupted, in an end region 3 of the side part 1, by two cutouts 4 which are arranged on the two longitudinal sides of the side part 1 and which have two edges 5 and 5'. In this case, the edge arranged further away from the end region 3 is designated by 5 and the edge lying nearer to the end region 3 is designated by 5'. In each case, formed approximately symmetrically, a cutout 6 running inward obliquely to the longitudinal axis of the side part 1 is provided, spaced apart somewhat from the edge 5, so that the two cutouts 6 are arranged in a V-shaped manner. The end region 3 and the middle region of the side part 1 are connected to one another by means of three webs 7. The webs 7 have a width of approximately 1.5 to 2 mm and form a predetermined breaking point 8. In this case, the cutouts 4 and 6 are arranged in such a way that in each case at least one sharp-edged corner region of the cutouts 4 and 6 delimits a web 7, so that a high notch effect is achieved and, as a result, the predetermined breaking point 8 breaks even under relatively low stresses. This occurs particularly in the event of a temperature change, as a result of which the coolant flat tubes expand in the direction of the block height, that is to say in the longitudinal direction of the side part, and said stress thereby arises on the side part and leads to a predetermined break, with the result that the coolant flat tubes are relieved of load. In this case, the side part is highly stable in the direction of the block width, so that the predetermined breaking point has no influence on the tensioning (cassetting) of the heat exchanger module.

Figure 4:
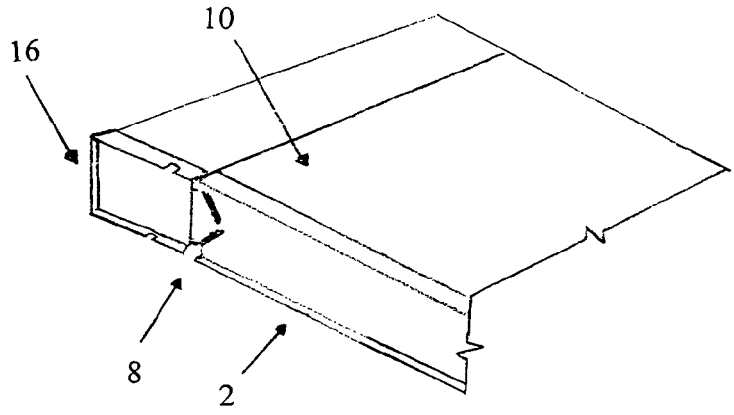
FIG. 4 shows a perspective view of a predetermined breaking point arranged in the region of a tube forming of a heat exchanger module.

FIG. 4 shows a perspective view of a predetermined breaking point 8 arranged in the region of a tube forming 10 of a heat exchanger module. A header tank 16 is arranged in the end region 3 of the heat exchanger module.

Figure 5:
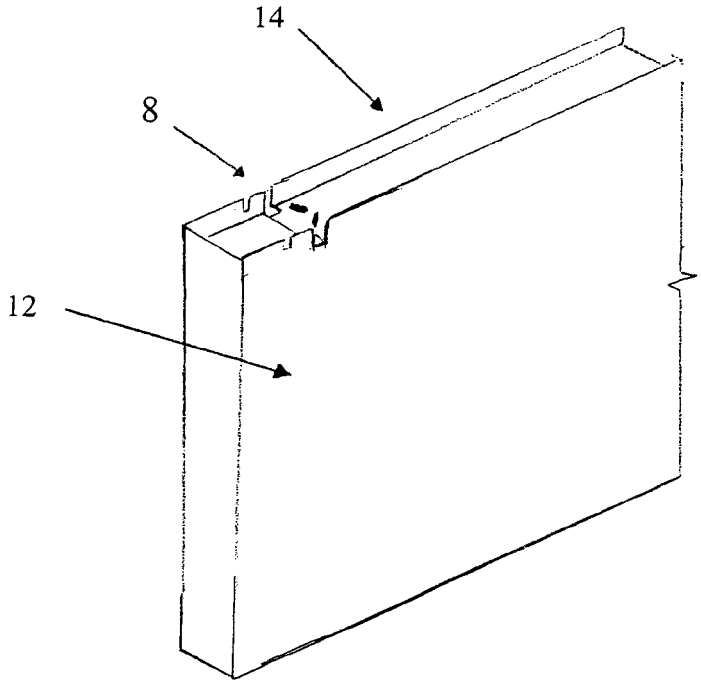
FIG. 5 shows a perspective view of a predetermined breaking point arranged at an interface between a condenser part and a coolant cooling part of a heat exchanger module.

FIG. 5 shows a perspective view of a predetermined breaking point 8 arranged at an interface between a condenser part 12 and a coolant cooling part 14 of a heat exchanger module.

LIST OF REFERENCE SYMBOLS

| | |
|---|---|
| 1 | Side part |
| 2 | Marginal region |
| 3 | End region |
| 4 | Cutout |
| 5, 5' | Edge |
| 6 | Cutout |
| 7 | Web |
| 8 | Predetermined breaking point |

The invention claimed is:

1. A heat exchanger module suitable for use in a motor vehicle, comprising:

a plurality of tubes and corrugated fins connected to one another to form a heat exchanger block;

at least one header tank connected to ends of the tubes; and two side parts which frame the heat exchanger module on opposite sides of the block, wherein at least one predetermined breaking region is provided on at least one side part, wherein the side parts comprise a base portion and marginal regions;

wherein the marginal regions of the side parts are bent through approximately 90° to form flanges along the longitudinal edges of the side part and at least one of the flanges along the longitudinal edge is interrupted by a cutout; wherein the cutout completely interrupts the flange along the longitudinal edge of the side part and penetrates partially into the base portion of the side part, and wherein the cutout cooperates with at least one aperture in the base portion of the side part to define between the cutout and the aperture a predetermined breaking point, and wherein the predetermined breaking point is adapted to break when subjected to thermally-induced stress caused in the tubes during operation of the heat exchanger.

2. The heat exchanger module as claimed in claim 1, wherein the predetermined breaking point is arranged in the region where the tubes are connected to the header tank.

3. The heat exchanger module as claimed in claim 1, wherein the predetermined breaking point is formed by a web defined between the cutout and the at least one aperture.

4. The heat exchanger module as claimed in claim 2, wherein the at least one side part comprises two of said cutouts on generally opposing edges of the side part and each of said cutouts forms a predetermined breaking point with the at least one aperture.

5. The heat exchanger module as claimed in claim 4, comprising two apertures in the base portion of the side part, one aperture cooperating with each of said cutouts to define a web therebetween, wherein said two apertures comprise slots that are arranged in V-shaped configuration with the diverging ends of the slots cooperating with the cutouts and the converging ends of the slots form between them a further web, whereby there is formed a V-shaped predetermined breaking region wherein the webs are arranged at the three corners of the V-shaped predetermined breaking region.

6. The heat exchanger module as claimed in claim 5, wherein the webs have a width of 0.5 to 2 mm.

7. The heat exchanger module as claimed in claim 3, wherein the cutouts are of rectilinear shape.

8. The heat exchanger module as claimed in claim 7, wherein the cutouts include at least one edge which includes an angle of 90° or less with respect to the longitudinal edge.

9. The heat exchanger module as claimed in claim 6, wherein the width of the webs is 1 to 1.5 mm.

10. The heat exchanger module as claimed in claim 1, wherein the cutouts form at least one rectilinear cutout in the base portion of the side parts.

11. The heat exchanger module as claimed in claim 1, wherein the cutouts form at least one sharp-edged corner region that defines the predetermined breaking point.

12. The heat exchanger module as claimed in claim 3, wherein the webs are formed entirely in the base portion of the side part.

13. The heat exchanger module as claimed in claim 1, wherein the heat exchanger comprises a first heat exchanger and a second heat exchanger that is different from the first heat exchanger and that is arranged next to the first heat exchanger and is connected to the first heat exchanger by the side parts.

14. The heat exchanger module as claimed in claim 1, wherein the heat exchanger module comprises a first heat exchanger and a second heat exchanger arranged parallel to one another, wherein the predetermined breaking point is arranged at an interface between the first heat exchanger and the second heat exchanger.

15. The heat exchanger module as claimed in claim 14, wherein the first heat exchanger is a radiator and the second heat exchanger is a condenser.

16. The heat exchanger module as claimed in claim 14, wherein the first heat exchanger and second heat exchanger are connected to one another as a unit via the fins and the side parts.

* * * * *